US010974943B2

(12) United States Patent
Honkawa et al.

(10) Patent No.: US 10,974,943 B2
(45) Date of Patent: Apr. 13, 2021

(54) METHOD AND APPARATUS FOR ILLUMINATING THE STATUS OF A CONSUMABLE

(71) Applicant: FIJI WATER COMPANY, LLC, Los Angeles, CA (US)

(72) Inventors: Bryan Honkawa, Malibu, CA (US); Clarence Chia, Redondo Beach, CA (US)

(73) Assignee: Fiji Water Company, LLC, Los Angeles, CA (US)

( * ) Notice: Subject to any disclaimer, the term of this patent is extended or adjusted under 35 U.S.C. 154(b) by 529 days.

(21) Appl. No.: 15/791,156

(22) Filed: Oct. 23, 2017

(65) Prior Publication Data

US 2018/0134539 A1 May 17, 2018

Related U.S. Application Data

(60) Provisional application No. 62/420,882, filed on Nov. 11, 2016.

(51) Int. Cl.

| | |
|---|---|
| ***B67D 1/00*** | (2006.01) |
| ***A47G 23/03*** | (2006.01) |
| ***B67D 1/08*** | (2006.01) |
| ***G08B 7/06*** | (2006.01) |

(52) U.S. Cl.

CPC ..... *B67D 1/0004* (2013.01); *A47G 23/0309* (2013.01); *B67D 1/0888* (2013.01); *G08B 7/068* (2013.01)

(58) Field of Classification Search

CPC .... B67D 1/0004; B67D 1/0888; G08B 7/068; A47G 23/0309

See application file for complete search history.

(56) References Cited

U.S. PATENT DOCUMENTS 1,013,582 A * 1/1912 Bedini ..... G08B 3/06 116/2
1,389,132 A * 8/1921 Galavan ..... A01K 7/025 362/101
1,714,333 A * 5/1929 Voss Karl ..... G08B 5/02 116/324
2,439,696 A * 4/1948 Schaal ..... F17C 13/003 116/313
2,663,866 A * 12/1953 Simpson ..... A47G 19/2227 340/689
2,674,675 A * 4/1954 Lambert ..... G08B 5/36 200/317

(Continued)

*Primary Examiner* — Nimeshkumar D Patel
*Assistant Examiner* — Tania Courson
(74) *Attorney, Agent, or Firm* — Cotman IP Law Group

(57) ABSTRACT

An apparatus for communicating the status of a consumable includes a sleeve with a tubular housing. The tubular housing has a lumen with a proximal section and a distal section separated by an internal flange. The sleeve includes a battery case or power module with a coaster coupled on the proximal side of the internal flange, an electronic module and a power supply module coupled to the distal side of the internal flange. A sensor in the form of a spring-loaded switch is located on the coaster to trigger and enable a status indicator based on a predetermined weight of a beverage container. The status indicator is an LED light source or wireless signal coupled to the sensor through the electronic module.

5 Claims, 11 Drawing Sheets

(56) References Cited

U.S. PATENT DOCUMENTS 2,745,947 A * 5/1956 Sansous ..... A47G 23/0309 362/109
3,434,134 A * 3/1969 Batchelor ..... G01F 23/205 340/613
3,810,164 A * 5/1974 Lambert ..... G08B 7/068 340/332
3,990,166 A * 11/1976 Nagelkirk ..... G09F 11/10 40/442
4,021,795 A * 5/1977 Hollingsworth ..... D01H 13/14 19/150
4,344,113 A * 8/1982 Ditto ..... A47G 23/0309 362/101
4,858,084 A * 8/1989 Sheryll ..... A47G 23/0309 362/101
4,922,355 A * 5/1990 Dietz ..... A47G 19/2227 362/101
4,926,786 A * 5/1990 White ..... G08B 5/02 116/2
4,930,902 A * 6/1990 Yata ..... A61J 9/02 215/11.2
5,010,461 A * 4/1991 Saotome ..... A47G 23/0309 362/101
5,083,391 A * 1/1992 Kyler ..... G09F 23/06 40/124.2
5,307,250 A * 4/1994 Pearson ..... A47G 23/0309 200/85 R
5,495,081 A * 2/1996 Ipcinski ..... H01H 13/14 200/276.1
5,553,735 A * 9/1996 Kimura ..... A47G 19/2227 220/62.18
5,594,409 A * 1/1997 Shank ..... G08B 7/068 340/286.06
5,704,162 A * 1/1998 Holtkamp, Jr. ..... A61L 9/127 47/79
5,785,407 A * 7/1998 Ratcliffe ..... F21V 23/04 362/101
5,839,458 A * 11/1998 Delcarson ..... G01D 5/04 134/113
5,990,790 A * 11/1999 Lusareta ..... A47G 23/0306 206/459.1
6,065,848 A * 5/2000 Tucker ..... A47G 19/2227 362/101
6,164,796 A * 12/2000 La Chiusa ..... F21S 9/02 362/122
6,254,247 B1 * 7/2001 Carson ..... A47G 19/2227 359/32
6,305,817 B1 * 10/2001 Johnston ..... A47G 23/0216 362/101
6,354,711 B1 * 3/2002 McCoy ..... A47G 23/0309 362/101
6,359,559 B1 * 3/2002 Rudell ..... A23G 3/50 340/540
6,366,196 B1 * 4/2002 Green ..... G06Q 50/12 340/10.6
6,379,018 B1 * 4/2002 Rycroft ..... A47G 23/0309 362/101
6,419,384 B1 * 7/2002 Lewis ..... A01K 7/00 200/61.45 R
6,786,614 B2 * 9/2004 Ciarrocchi, Jr. ... A47G 23/0309 362/101
6,793,363 B2 * 9/2004 Jensen ..... A47G 23/0309 362/101
6,863,415 B2 * 3/2005 Lu ..... A47G 23/0309 362/101
7,018,062 B2 * 3/2006 Taylor ..... A47G 19/2227 362/101
7,369,039 B1 * 5/2008 Knutson ..... G08B 5/36 340/286.09
7,419,072 B1 * 9/2008 Vanella ..... A47G 23/0309 222/113
7,501,933 B2 * 3/2009 Rousso ..... A47G 19/2227 206/217
7,690,533 B2 * 4/2010 Stilley ..... B05B 1/002 222/113
7,817,058 B2 * 10/2010 Waterhouse ..... G08B 5/36 340/286.06
D630,124 S * 1/2011 Connell ..... D11/152
7,926,966 B2 * 4/2011 Winters ..... F21V 33/0024 362/101
8,072,316 B2 * 12/2011 Mannke, Jr. ..... G08B 7/068 116/202
8,152,321 B2 * 4/2012 Lindholm ..... A47G 23/0225 362/101
RE43,771 E * 10/2012 Koncelik, Jr. ..... A47J 31/52 116/201
8,493,217 B2 * 7/2013 Biessman ..... G08B 7/068 340/573.1
8,548,856 B2 * 10/2013 Maruszak ..... G06Q 30/02 705/15
8,827,496 B2 * 9/2014 Vanderschuit ..... F21V 23/02 362/277
8,919,981 B2 * 12/2014 Wang ..... A47G 23/02 362/101
9,432,758 B1 * 8/2016 Kirk ..... H04R 1/028
9,545,166 B2 * 1/2017 Wells ..... F21V 23/0471
9,764,842 B2 * 9/2017 Woicekowski ..... B64D 11/003
9,839,310 B2 * 12/2017 Mongeli ..... A47G 19/2227
10,638,864 B2 * 5/2020 Abukar ..... A61J 9/0646
2004/0017678 A1 * 1/2004 Liu ..... A47G 19/2227 362/101
2004/0114352 A1 * 6/2004 Jensen ..... A47G 23/0309 362/101
2004/0125594 A1 * 7/2004 Wu ..... A47G 23/0309 362/101
2004/0212987 A1 * 10/2004 Lu ..... B43K 23/001 362/101
2004/0246705 A1 * 12/2004 Lu ..... A47G 23/0309 362/101
2006/0109644 A1 * 5/2006 Saucier, Sr. ..... B65D 23/12 362/101
2010/0147844 A1 * 6/2010 Connell ..... A01G 9/021 220/62.18
2014/0300273 A1 * 10/2014 LeBrun ..... A47G 19/2227 315/76

* cited by examiner

METHOD AND APPARATUS FOR ILLUMINATING THE STATUS OF A CONSUMABLE

CROSS-REFERENCE TO RELATED APPLICATIONS

The present application is claims the benefit of U.S. Provisional Application Ser. No. 62/420,882, filed on Nov. 11, 2016, specification of which is herein incorporated by reference for completeness of disclosure.

BACKGROUND OF THE INVENTION

Field of the Invention

Embodiments of the invention relates to visual feedback systems. More specifically, the invention relates to a method and apparatus for communicating the status of a consumable.

Description of the Related Art

Currently, when a restaurant patron orders a bottled water, a glass of water, or any other beverage, a waiter brings the beverage and places it on the table. The patron consumes the beverage and sometimes would have to wait for a long time before a refill. This is primarily because the most prominent way to know that the patron needs a refill is either by the waiter coming to the table and observing that the beverage container is empty or by the patron summoning the waiter and alerting him about needing a refill.

The perceived lack of responsiveness to the patron's needs sometimes lead to frustration and dissatisfaction with a particular establishment.

There are currently no known systems in restaurants of similar environments that provide automatic feedback to waiters of when a patron needs a refill of a beverage, e.g. water.

To overcome the problems and limitations described above there is a need for a method and apparatus for illuminating the status of a consumable.

BRIEF SUMMARY OF THE INVENTION

One or more embodiments of the invention are directed a method and apparatus for communicating the status of a consumable. The invention is a sleeve for providing a visual indication of the status of beverage in a bottle. For instance, in a restaurant environment with one or more sleeves on each table for bottled water, when a customer requests service of water, a bottle is placed in the sleeve on the table thereby enabling the status indicator. In the exemplary embodiment, the status indicator is a light source comprising one or more light emitting diodes (LED). Enabling the light serves multiple purposes, e.g. providing some lighting to the table and also indicating the status of the water in the bottle. Thus, a waiter that passes by the table can easily ascertain whether or not the customer needs a replacement bottle by the status of the light. The sleeve can be configured for use with a can, cup, etc.

In one or more embodiments, the sleeve comprises a tubular housing with a lumen. The lumen is divided into a proximal or top section and a distal or bottom section. The bottom and top sections are separated by an internal flange.

In one or more embodiments, the sleeve further comprises a power module coupled in the lumen of the tubular housing.

The power module comprises a coaster coupled on the proximal side of the internal flange, an electronic module and a power supply module coupled to the distal side of the internal flange. The electronic module is housed in a chamber above the power supply module The sleeve further comprises a sensor coupled to the electronic module for determining the level of beverage in a beverage container. In one or more embodiments, the sensor is a spring-loaded switch on the coaster that is configured to trigger and enable the status indicator based on a predetermined weight of the beverage container.

The sleeve further comprises a status indicator coupled to the sensor. In one or more embodiments, the status indicator is one or more LED light source on the coaster.

In other embodiments of the present invention, the apparatus comprises a coaster for a beverage container. A power module with an electronic module and a power supply module that is coupled to the coaster. A sensor is coupled to the coaster for determining the status of beverage in a beverage container. The sensor is in electrical communication with the electronic module. The apparatus further includes a status indicator coupled to the sensor.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

Figure 1:
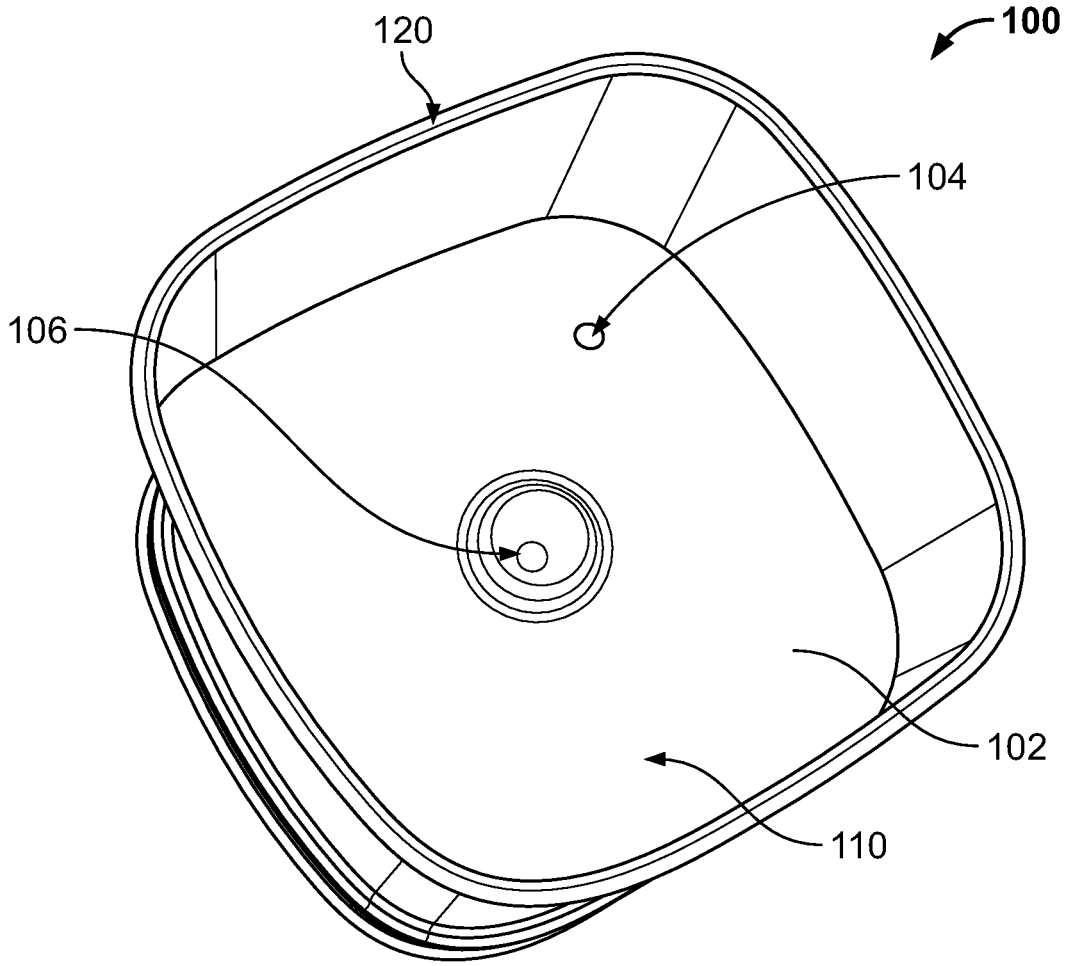
FIG. 1 is a top perspective view of a sleeve for holding a bottle in accordance with one or more embodiments of the present invention.

The present invention comprising a method and apparatus for communicating the status of a consumable will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Furthermore, although steps or processes are set forth in an exemplary order to provide an understanding of one or more systems and methods, the exemplary order is not meant to be limiting. One of ordinary skill in the art would recognize that the steps or processes may be performed in a different order, and that one or more steps or processes may be performed simultaneously or in multiple process flows without departing from the spirit or the scope of the invention. In other instances, specific features, quantities, or measurements well known to those of ordinary skill in the art have not been described in detail so as not to obscure the invention. It should be noted that although examples of the invention are set forth herein, the claims, and the full scope of any equivalents, are what define the metes and bounds of the invention.

For a better understanding of the disclosed embodiment, its operating advantages, and the specified object attained by its uses, reference should be made to the accompanying drawings and descriptive matter in which there are illustrated exemplary disclosed embodiments. The disclosed embodiments are not intended to be limited to the specific forms set forth herein. It is understood that various omissions and substitutions of equivalents are contemplated as circumstances may suggest or render expedient, but these are intended to cover the application or implementation.

The term "first", "second" and the like, herein do not denote any order, quantity or importance, but rather are used to distinguish one element from another, and the terms "a" and "an" herein do not denote a limitation of quantity, but rather denote the presence of at least one of the referenced item.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein. For the purposes of this application, the term lumen may be interchanged with lumen cavity and both lumen and lumen cavity may be defined as the cavity of a tubular part.

One or more embodiments of the present invention will now be described with references to FIGS. 1-11.

FIG. 1 is a top perspective view of sleeve 100 for holding a bottle in accordance with one or more embodiments of the present invention. As illustrated, sleeve 100 comprises body (or housing) 120; power module 110 coupled to and housed inside body 100; a switch 104; and a status indicator 106.

Figure 2A:
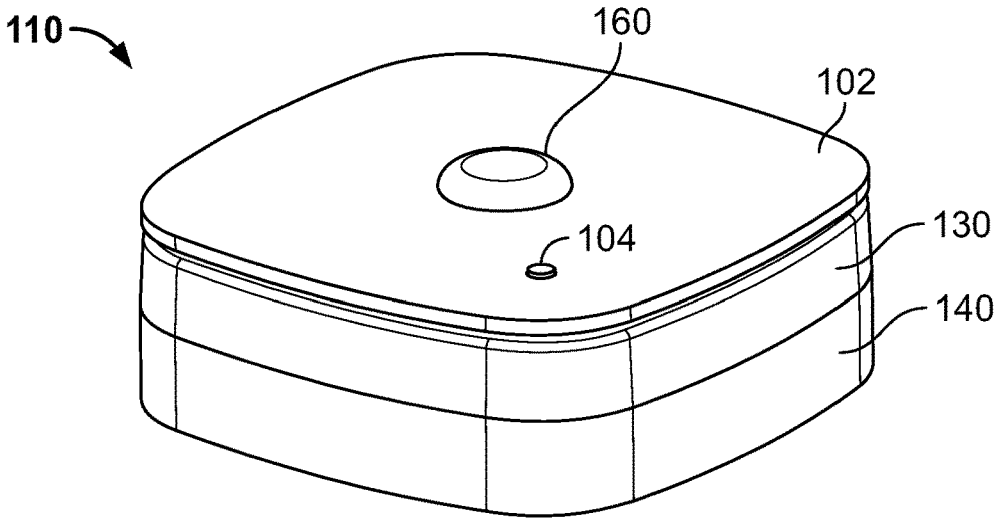
FIG. 2A is an isometric view of the power module of the sleeve in accordance with one or more embodiments of the present invention.
Figure 2B:
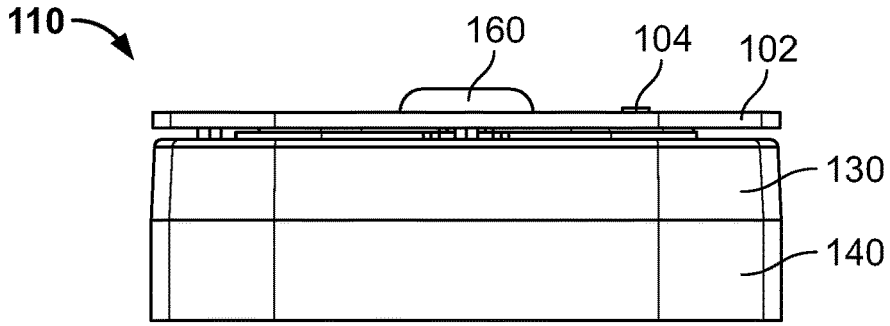
FIG. 2B is side elevational view of the power module of the sleeve in accordance with one or more embodiments of the present invention.
Figure 2C:
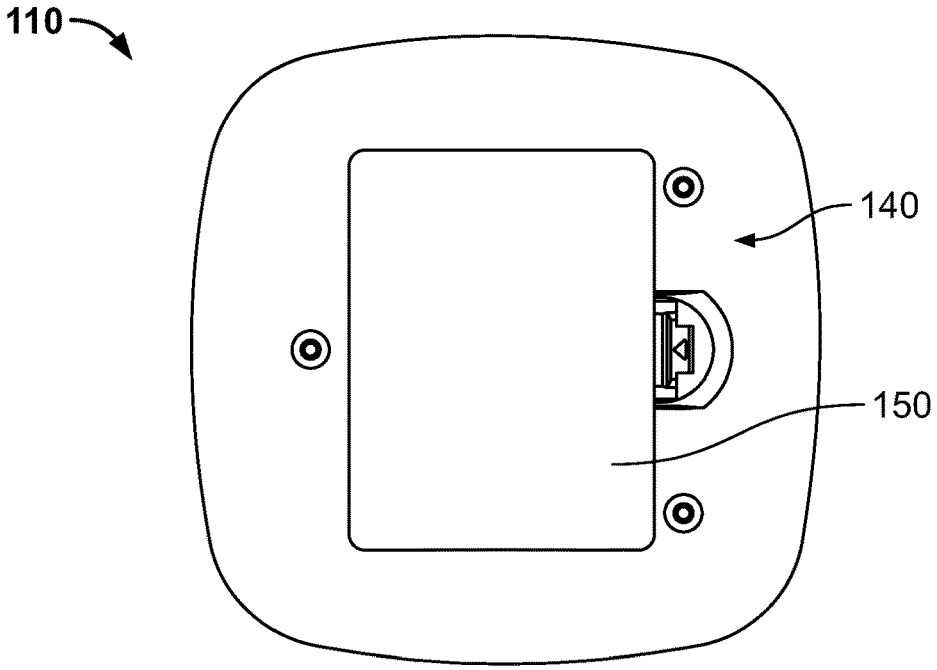
FIG. 2C is bottom plan view of the power module of the sleeve in accordance with one or more embodiments of the present invention.

FIGS. 2A-2C are different views of the power module 110 of the sleeve in accordance with one or more embodiments of the present invention. As illustrated, power module 110 comprises beverage coaster 102; electronic module container or top cover 130; bottom cover or power supply module 140; battery compartment cover 150; switch 104; and status indicator 106.

Figure 3:
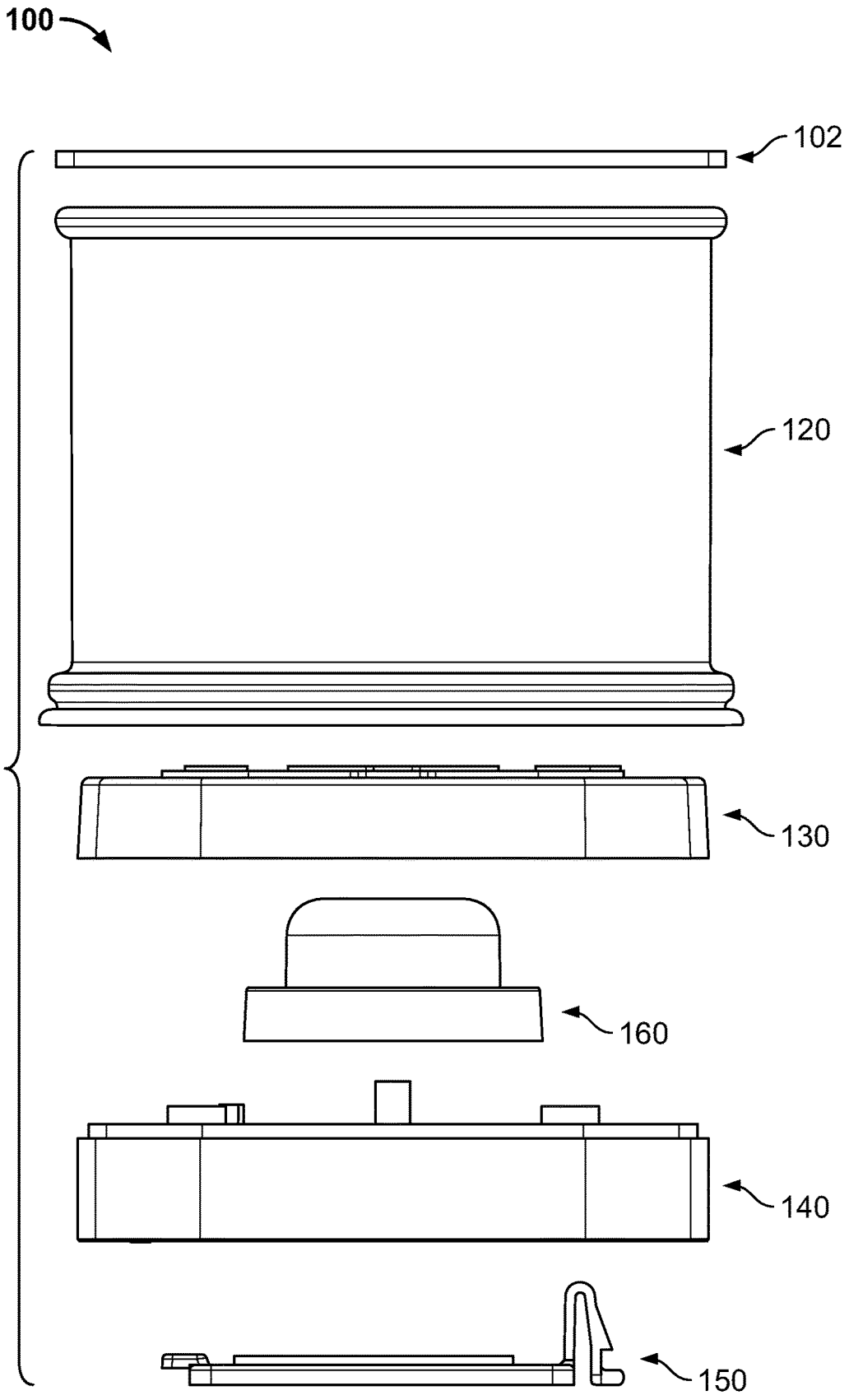
FIG. 3 is an exploded view of the sleeve in accordance with one or more embodiments of the present invention.

FIG. 3 is an exploded view of the sleeve 100 to show relationship of the components in accordance with one or more embodiments of the present invention. As illustrated, beverage coaster 102 is coupled to the remainder of the power module 110 through inward projecting flange 122 at the proximal end 128 (i.e. top section) of the housing 120

(see FIG. 4). Internal flange 122 includes one or more guiding holes 126 for corresponding guideposts 116 (see FIG. 5B). Each guidepost 116 on the backside of beverage coaster 102 is configured to fit into a corresponding guiding hole 126 on flange 122.

The remaining elements of the power module 110 are coupled to the distal end 124 (i.e. bottom section) of the housing 120. As illustrated in FIG. 3, the relationship of the elements is such that the battery compartment cover 150 is coupled to the bottom side of the bottom cover 140; lampshade 160 is located between bottom cover 140 and top cover 130; and top cover 130 resides on the distal side of flange 122 and inside the housing 120 at section 124.

Figure 4A:
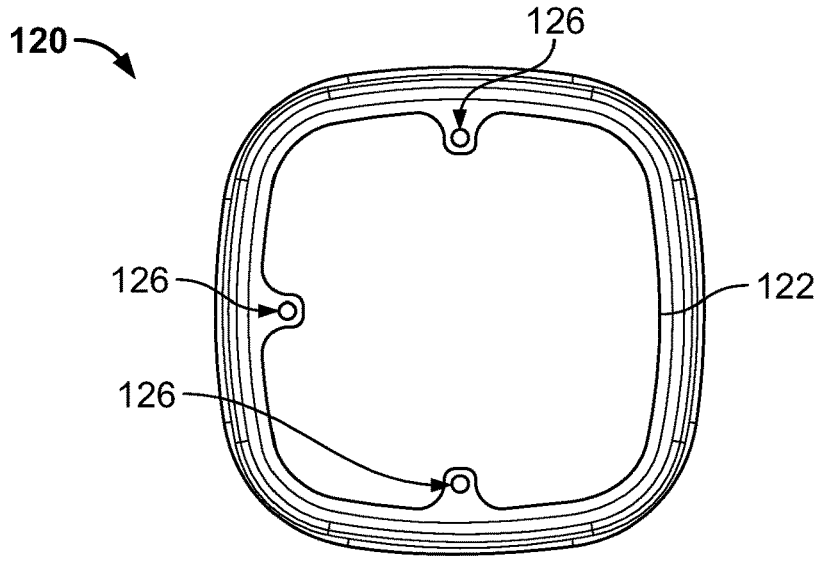
FIG. 4A is top plan view of the housing of the sleeve in accordance with one or more embodiments of the present invention.
Figure 4B:
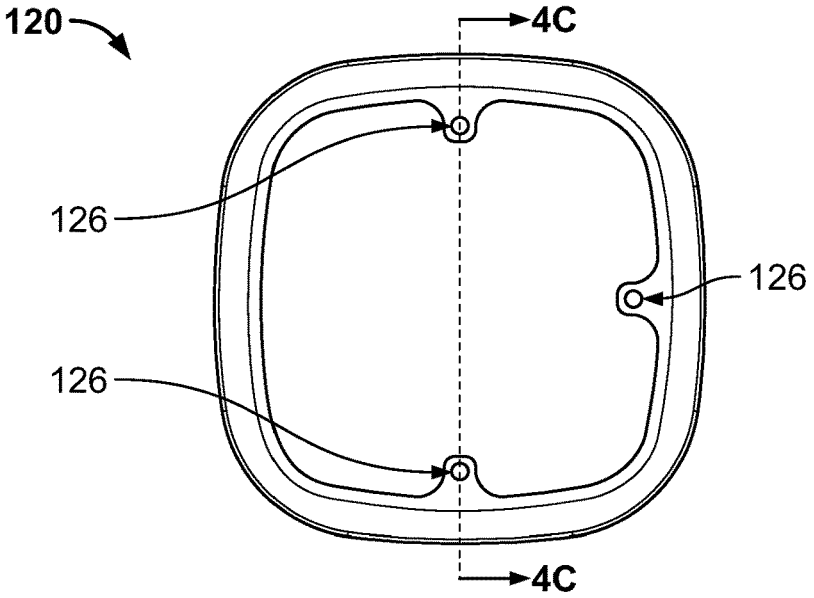
FIG. 4B is bottom plan view of the housing of the sleeve in accordance with one or more embodiments of the present invention.
Figure 4C:
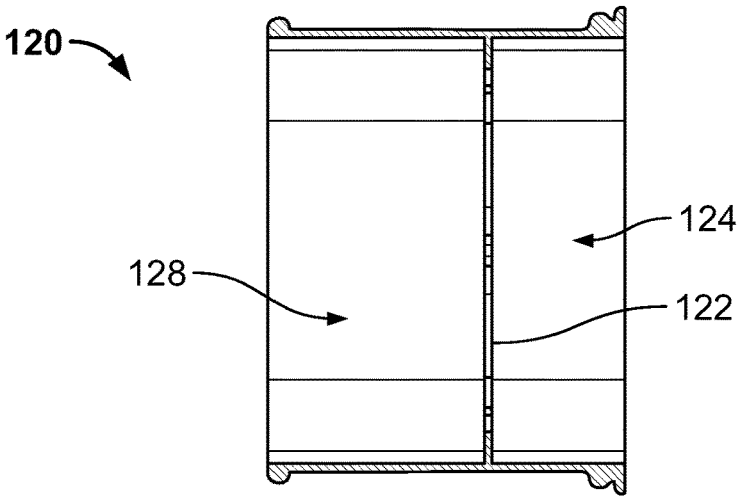
FIG. 4C is cross-sectional view of section A-A of the housing of the sleeve in accordance with one or more embodiments of the present invention.

FIGS. 4A-C are different views of the housing 120 in accordance with one or more embodiments of the present invention. As illustrated, housing 120 is a tubular member with a lumen comprising a top section 128 and a bottom section 124 separated by an inward projecting flange (or shelf) 122. Flange 122 includes one or more guiding holes 126. Preferably, flange 122 includes two or more guiding holes to minimize any rotational movement of the beverage coaster inside the housing. Specifically, in the illustrated embodiment, flange 122 includes three guiding holes on three sides of the substantially four sided housing. Preferably, the internal shape of housing 120 will depend on the shape of beverage bottle 10 (see FIG. 11). For instance, the shape of housing 120 could be cylindrical, square (with or without rounded edges), rectangular (with or without rounded edges), or any other desirable shape that can hold a beverage container. However, those of skill in the art would appreciate that the internal shape of housing 120 does not have to be configured for a specific beverage container and that shapes that can accommodate different type and size containers are contemplated.

Figure 5A:
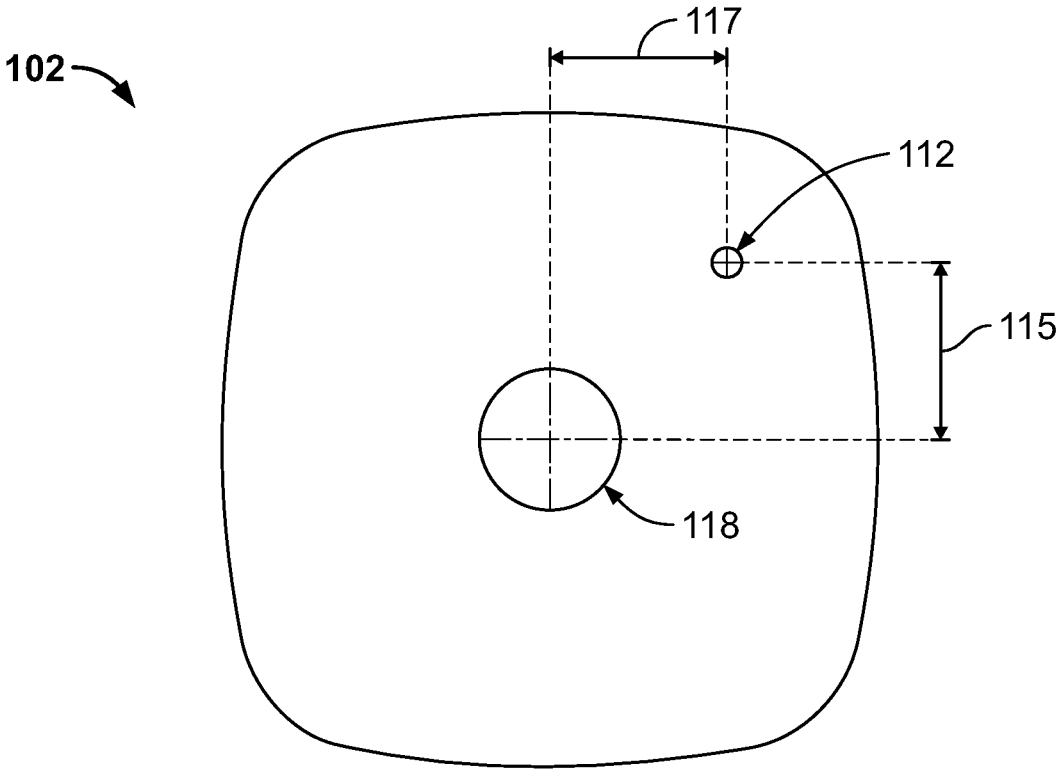
FIG. 5A is top plan view of beverage coaster of the power module in accordance with one or more embodiments of the present invention.
Figure 5B:
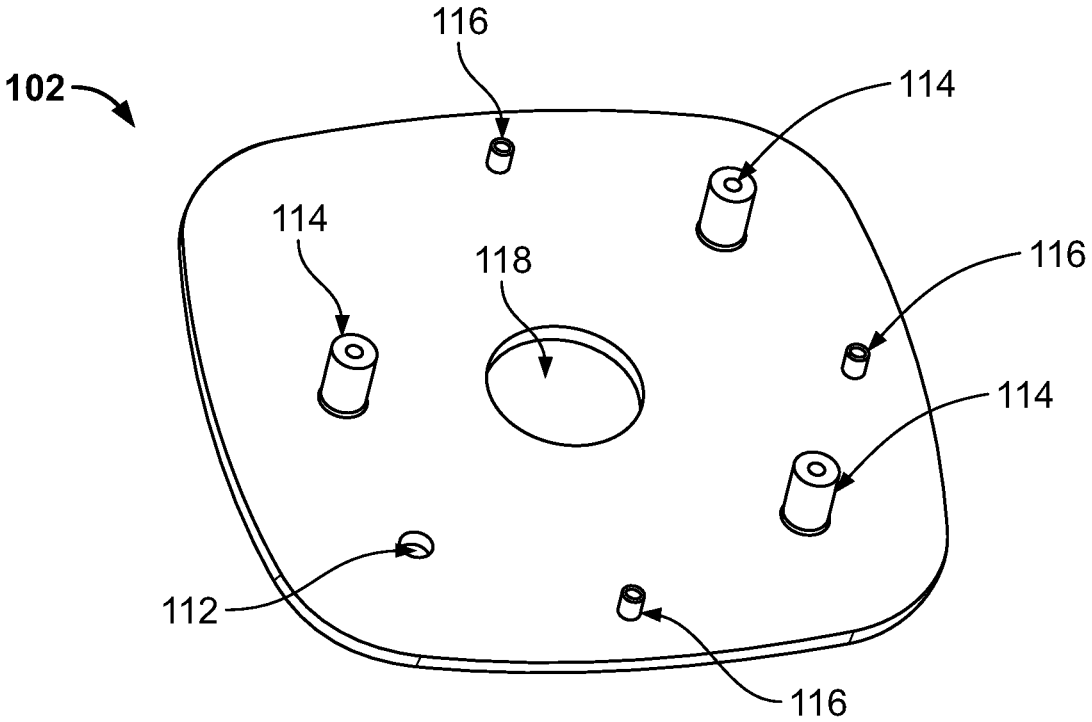
FIG. 5B is bottom perspective view of beverage coaster of the power module in accordance with one or more embodiments of the present invention.

FIGS. 5A-B are different views of beverage coaster 102 of the power module in accordance with one or more embodiments of the present invention. As illustrated, beverage coaster 102 includes a hole 112 for switch 104 and hole 118 for status indicator 106. Switch 104 is preferably spring-loaded such that it is enabled upon compression by the weight of an object placed on it. In one or more embodiments, spring-loaded switch 104 and status indicator 106 are coupled to electronic circuitry, e.g. circuit board (not shown), in top cover 130. The function of switch 104 is to activate the status indicator 106 when a beverage bottle of a predetermined threshold weight is placed on the coaster 102. Thus, as the beverage in the bottle 10 is consumed, the weight of the bottle and its content decreases and eventually falls below the predetermined threshold weight thereby disengaging the switch. Those of skill in the art would appreciate that other types of switches are contemplated. For example, a sensor on the sidewalls that senses beverage level in the bottle could be used instead of a spring-loaded switch on the coaster, optical switches, etc.

In one or more embodiments, switch 104 is located such that its X and Y distances from the center of the coaster (i.e. 115 and 117) is such that the switch can be optimally activated by the bottom wall of the beverage bottle 10.

In one or more embodiments, the status indicator 106 is an LED light source which includes lampshade 160. An LED lamp (not shown), which is covered by the lampshade 160, lights up when a beverage bottle 10 with sufficient liquid is placed inside the sleeve, i.e. on top of the coaster 102, to visually indicate that the bottle is not empty. Those of skill in the art would appreciate that the status indicator 106 could also be on the outside of the sleeve. In a preferred embodiment, the LED lamp is off when there is no beverage bottle in the sleeve or when the level of the beverage in the bottle causes the weight of bottle and beverage combination to fall below the predetermined threshold value.

In other embodiments of the invention, status indicator 106 could comprise a wireless radio, e.g. Bluetooth, that transmits the status of each sleeve 100 to a mobile device or similar device, e.g. smartphone, computer, tablet, etc. (i.e. smart device). In such embodiment, the status indicator is a signal configured to be wirelessly communicated to a smart device, for example.

Figure 8A:
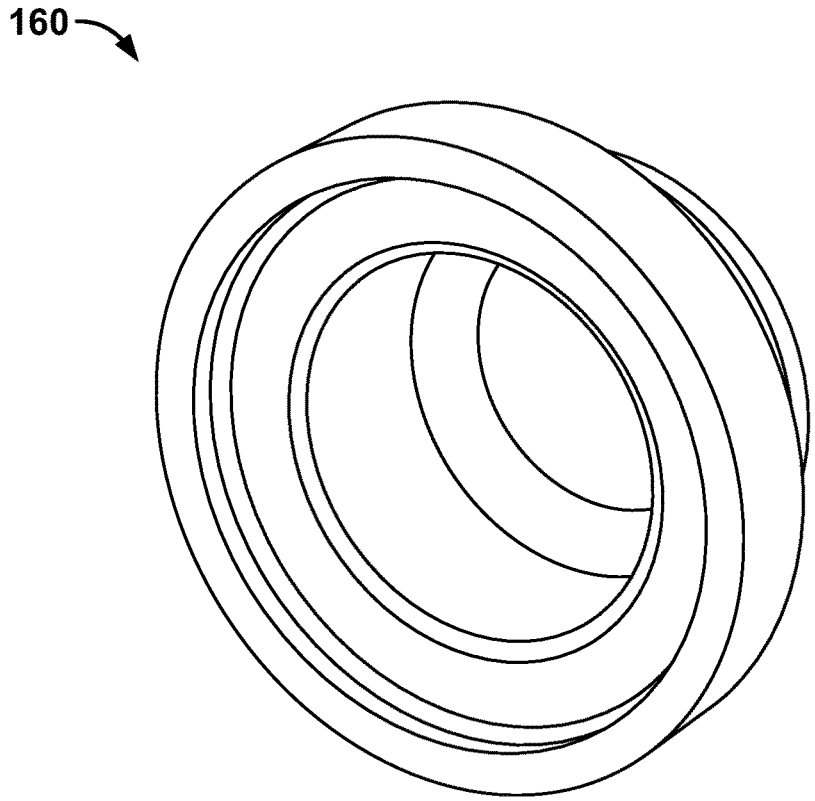
FIG. 8A is bottom isometric view of the lampshade of the power module in accordance with one or more embodiments of the present invention.
Figure 8B:
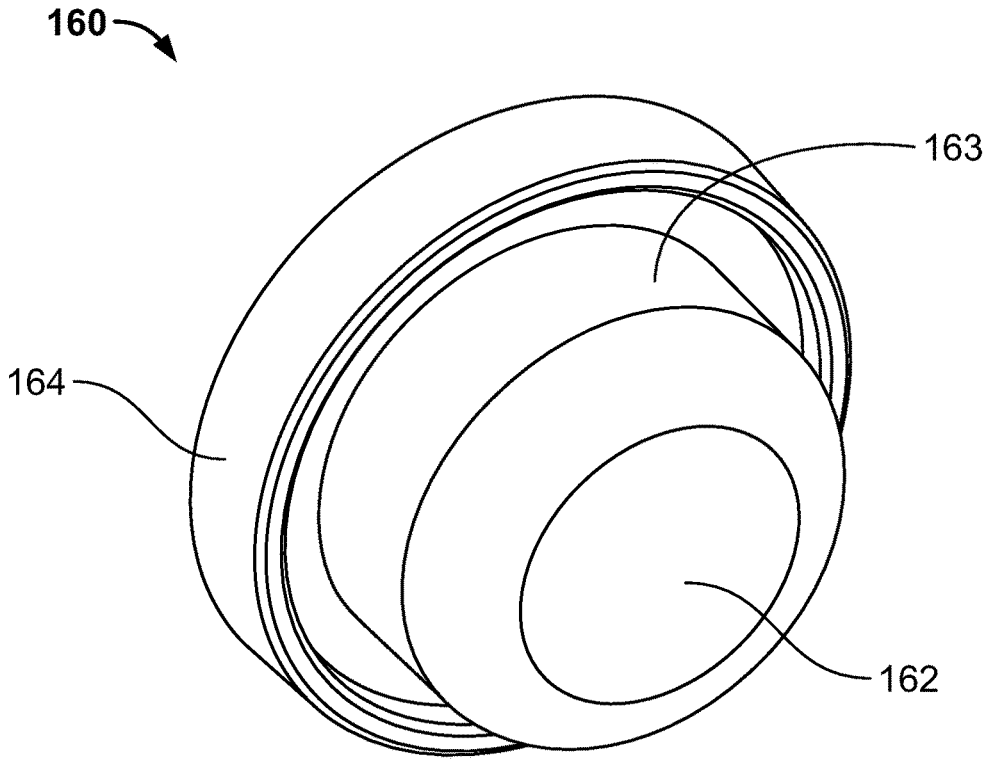
FIG. 8B is top isometric view of the lampshade of the power module in accordance with one or more embodiments of the present invention.

FIGS. 8A-B are different views of the lampshade 160 of the power module in accordance with one or more embodiments of the present invention. As illustrated, the lampshade comprises a top wall 162 with a downward flowing sidewall 163 which terminates into an outward flange 164. When installed in the top cover 130, the flange 164 is on the bottom side of top cover 130 while top wall 162 fits through hole 138 of top cover 130 and is exposed on the topside of top cover 130 and also fits through hole 118 of coaster 102. Hole 138 in top cover 130 and hole 118 in coaster 102 are sized to fit the outside perimeter of the sidewall 163 of the lampshade.

Returning back to FIG. 5B, the bottom side of the coaster 102 comprises one or more guideposts 116. Each of the one or more guideposts 116 sized to fit into a corresponding one of guide hole 126 on flange 122 of housing 120. The bottom side of the coaster 102 further comprises one or more coupling posts 114. Each coupling post 114 includes a threaded hole for securing the top cover 130 and bottom cover 140 to the coaster 102.

Figure 6A:
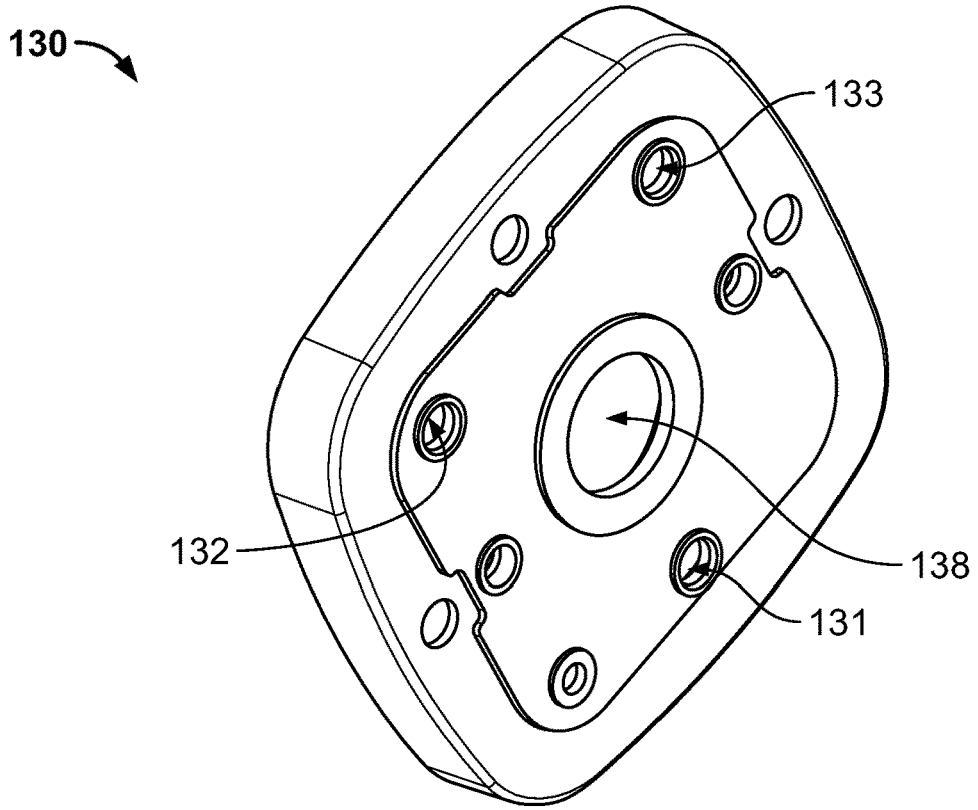
FIG. 6A is top isometric view of the top cover of the power module in accordance with one or more embodiments of the present invention.
Figure 6B:
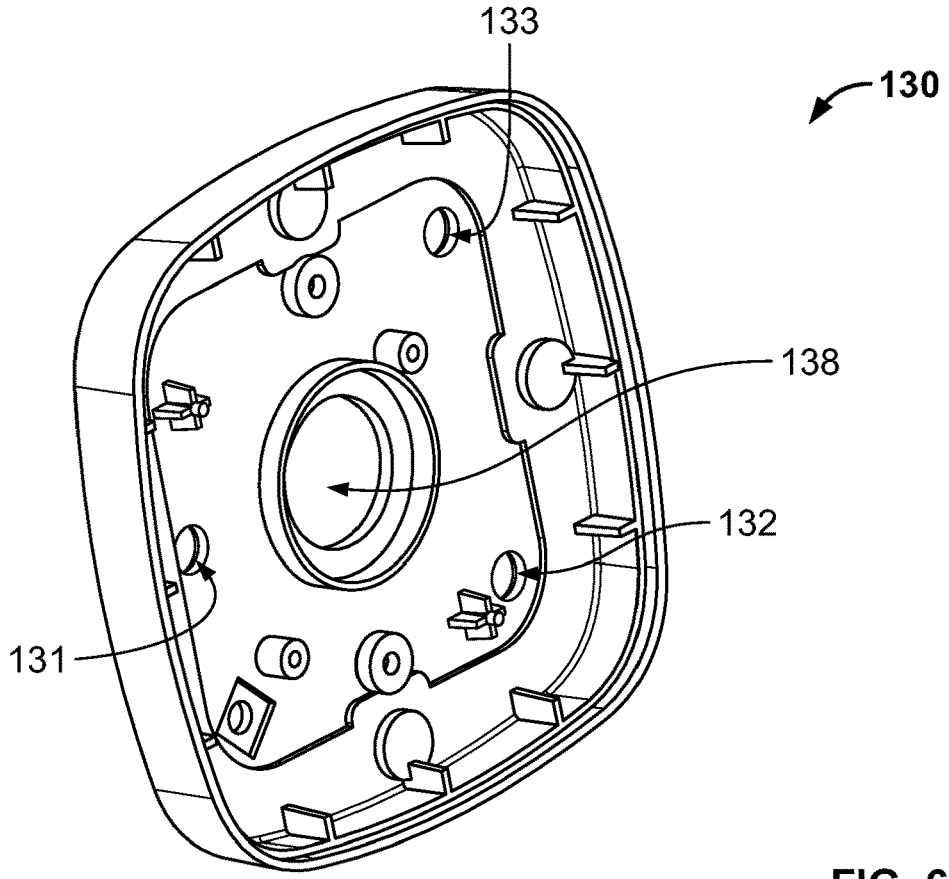
FIG. 6B is bottom isometric view of the top cover of the power module in accordance with one or more embodiments of the present invention.

FIGS. 6A-B are different views of the top cover (or electronic module) 130 of the power module 110 in accordance with one or more embodiments of the present invention. The top cover 130 is configured to house the electronic components for control of the status indicator 106, e.g. a circuit board. The electronic components may include a microcontroller, for instance. The switch 104 and status indicator 106 are coupled to electronic components housed in the top cover 130. The top cover further includes one or more holes 131-133. Each hole, e.g. 131-133, acts as a pass-through for a bolt for coupling the bottom cover 140 to a corresponding threaded hole in post 114 of coaster 102 thereby coupling together the entire power module assembly 110.

Figure 7A:
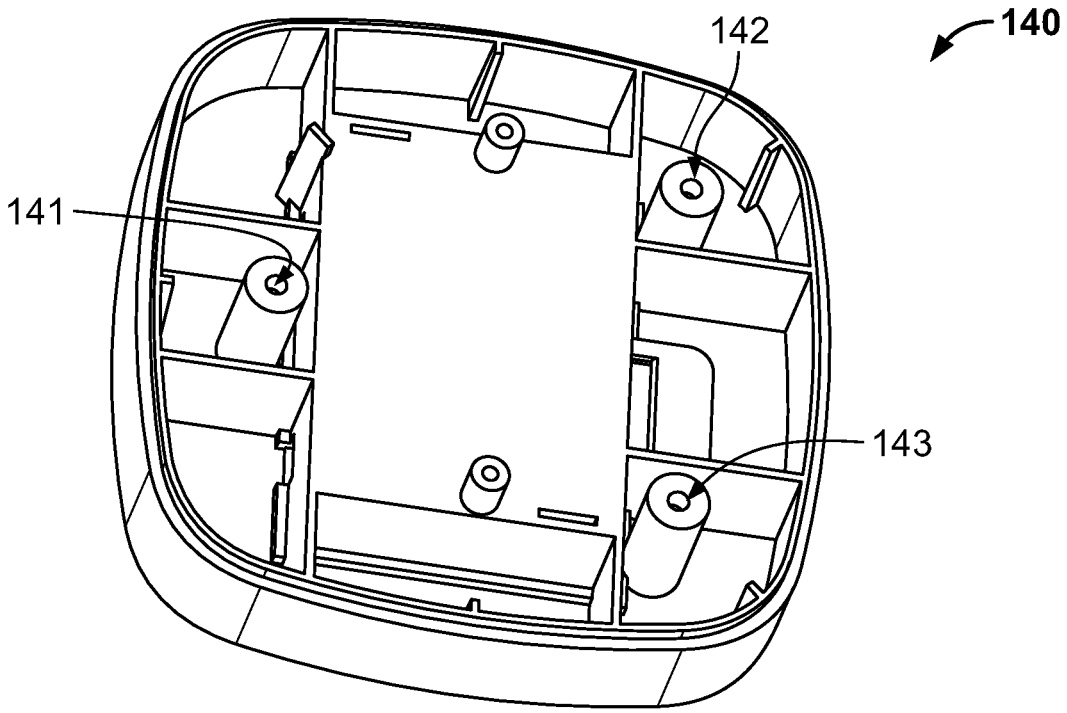
FIG. 7A is top isometric view of the bottom cover of the power module in accordance with one or more embodiments of the present invention.
Figure 7B:
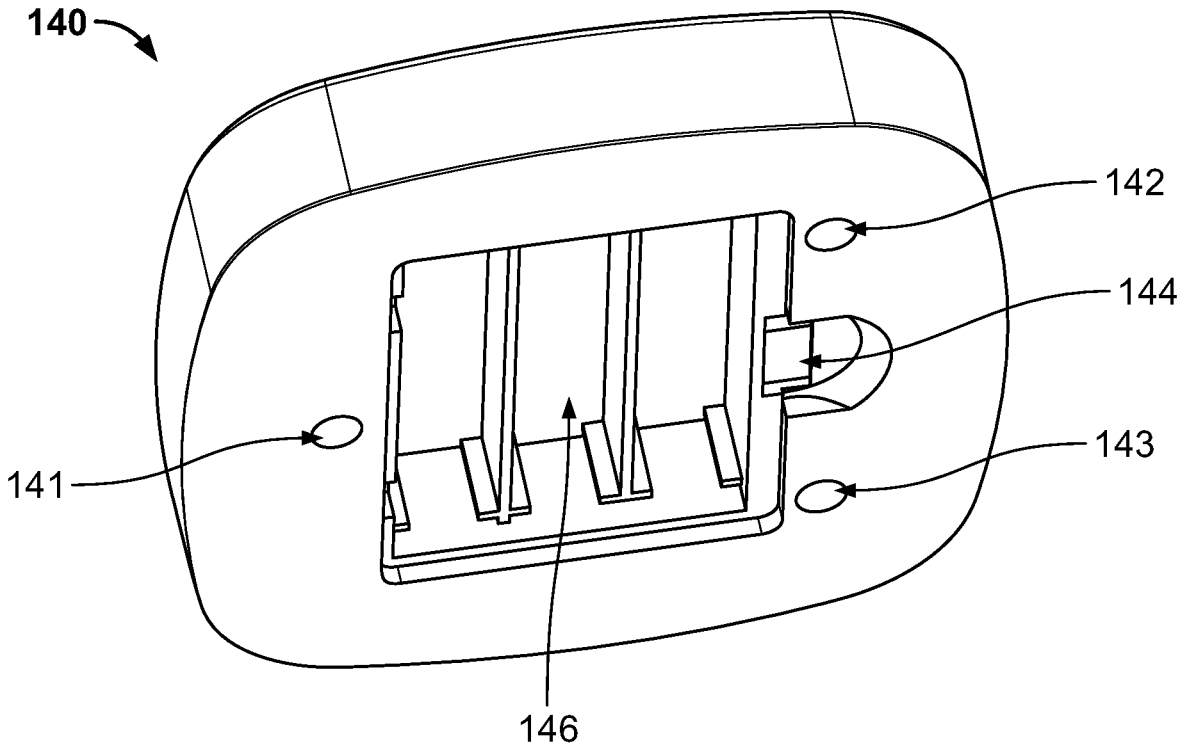
FIG. 7B is bottom isometric view of the bottom cover of the power module in accordance with one or more embodiments of the present invention.

FIGS. 7A-B are different views of the bottom cover (or power supply module) 140 of the power module 110 in accordance with one or more embodiments of the present invention. As illustrated, the bottom cover may be configured to house one or more batteries and/or power regulators (e.g. transformers) for the electronic components in battery compartment 146. Those of skill in the art would appreciate that various types of power sources could be employed. For instance, the power supply could be from one or more batteries, an electrical power outlet, etc. Rechargeable batteries could also be used with an external power connector in the power module 110 for recharging the batteries.

In one or more embodiments, the bottom cover 140 further includes one or more through holes, e.g. 141-143, that run its entire height. Each hole, e.g. 141-143, is configured to accept a bolt for coupling the bottom cover 140 to a corresponding threaded hole in post 114 of coaster 102 thereby holding together the entire power supply assembly 110.

Figure 9A:
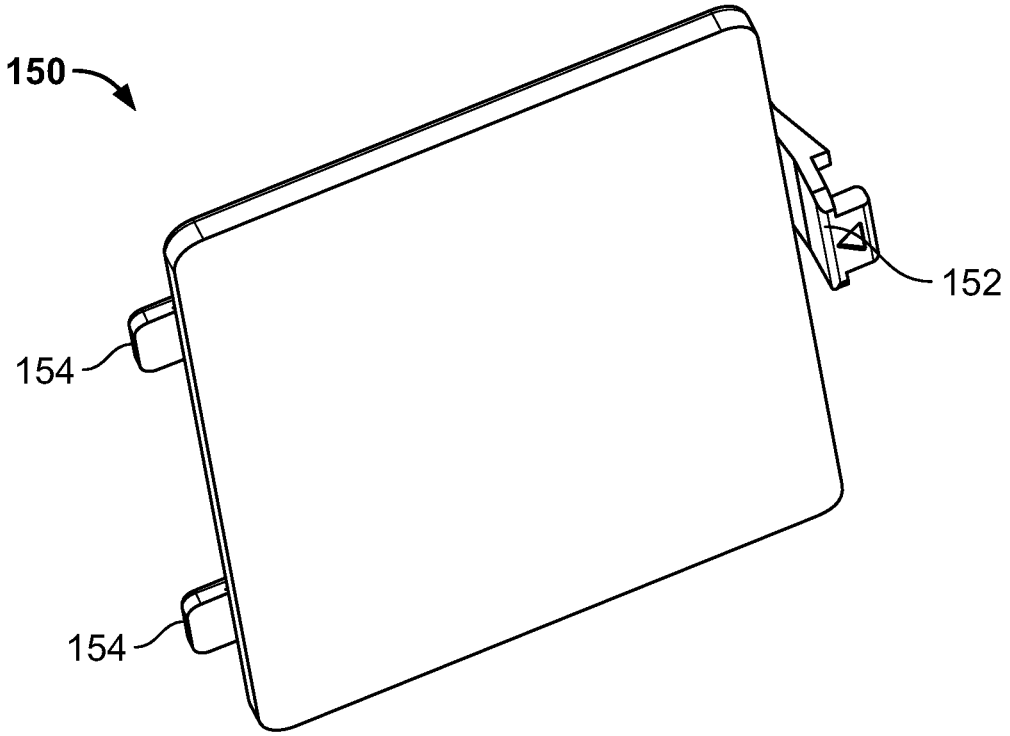
FIG. 9A is bottom isometric view of the battery cover of the battery compartment in accordance with one or more embodiments of the present invention.
Figure 9B:
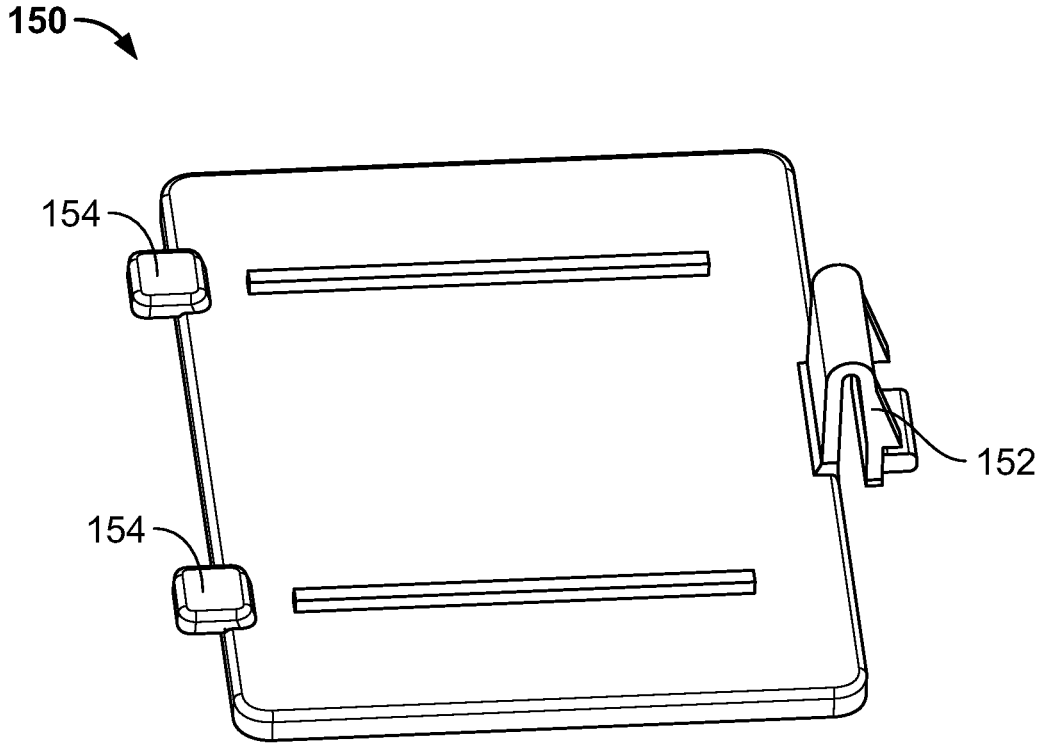
FIG. 9B is top isometric view of the battery cover of the battery compartment in accordance with one or more embodiments of the present invention.

Battery cover 150 secures the one or more batteries in the battery compartment 146. FIGS. 9A-B are different views of the battery compartment cover 150 in accordance with one or more embodiments of the present invention. The battery compartment cover 150 includes one or more flaps, e.g. 154, at one end that fit into the distal end of the battery compartment and a latch 152 at the opposing end that engages with a latch hole 144 at the proximal end of the battery compartment 146.

Figure 10:
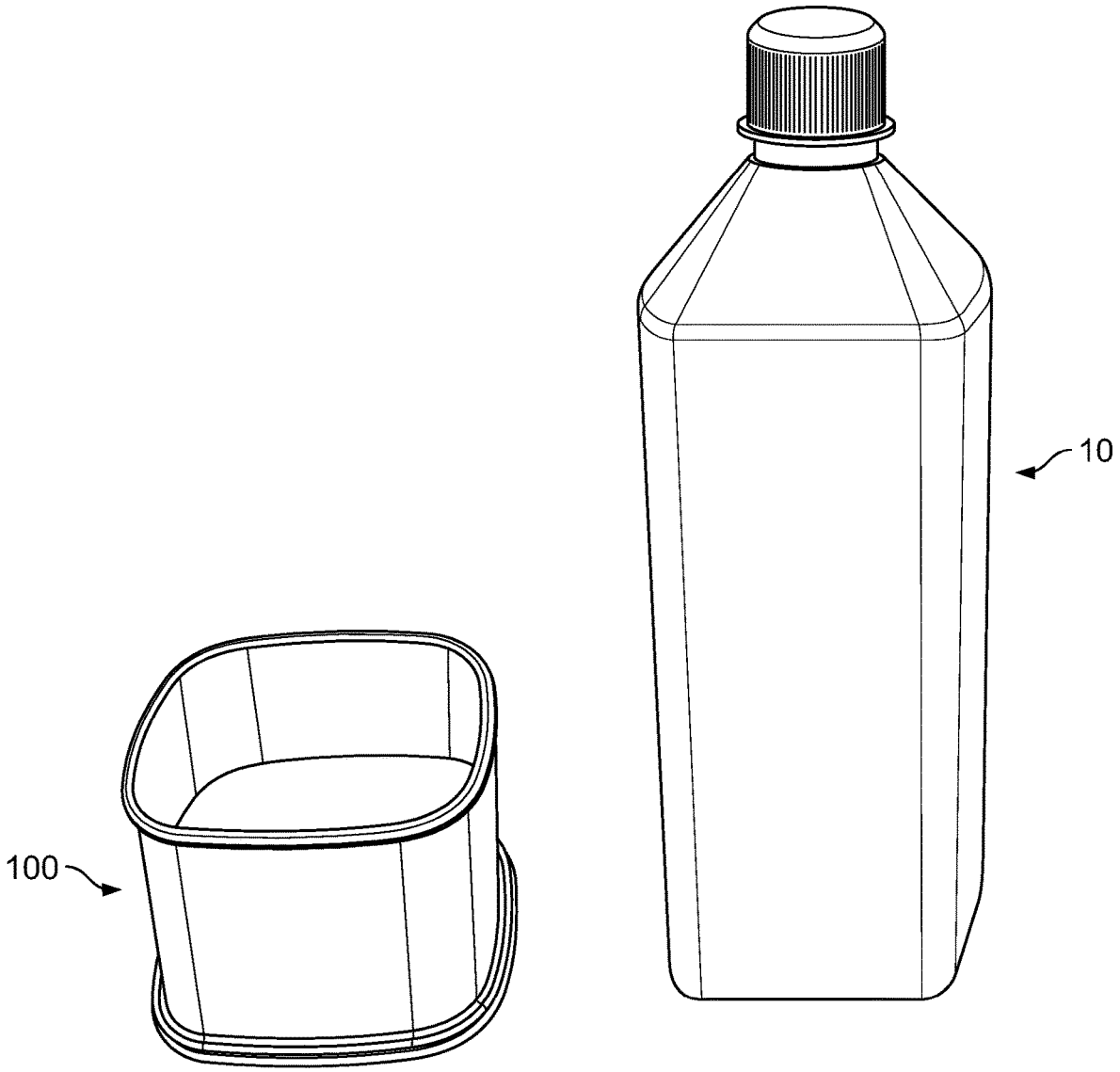
FIG. 10 is an illustration showing the sleeve and a corresponding water bottle side by side in accordance with one or more embodiments of the present invention.
Figure 11:
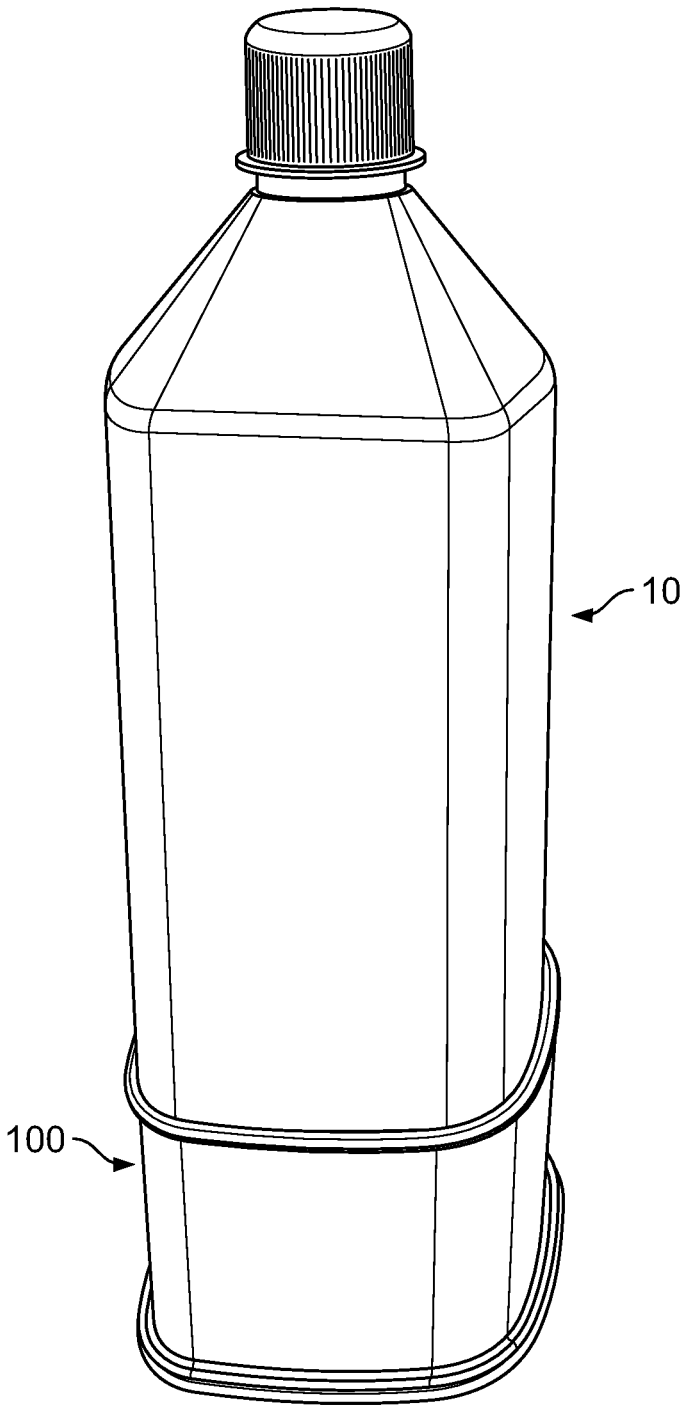
FIG. 11 is an illustration showing the water bottle inside the sleeve in accordance with one or more embodiments of the present invention.

FIG. 10 is an illustration of the sleeve 100 before a corresponding water bottle 10 is placed inside the sleeve. FIG. 11 is an illustration of the water bottle 10 inside the sleeve 100. One purpose of the invention is to provide a visual indication of the status of the beverage in the bottle. For instance, assuming a restaurant environment with one or more sleeves on each table for bottled water. When the customer requests service of water, a bottle is placed in a sleeve on the table thereby enabling the status indicator 106. In the exemplary embodiment where the status indicator is a light source, enabling the light serves multiple purposes, e.g. providing some lighting to the table and also indicating the status of the water in the bottle. Thus, a waiter that passes by the table can easily ascertain whether or not the customer needs a replacement bottle by the status of the light. Of course, the sleeve is not limited to use with a bottle. For instance, it could be used with cans, drinking glasses, etc.

In one or more embodiments of the present invention, the apparatus comprises a coaster 102 for a beverage container. The coaster may optionally be coupled to a housing such as sleeve 120, or a shell body of any other shape. The coaster 102 may be inside the housing or on top of the housing. A sensor is coupled to the coaster for sensing and providing the status of beverage in a beverage container placed on top of the coaster. A power module is coupled to the housing. In one or more embodiments, the power module comprises an electronic module and a power supply module. The electronic module may include a microcontroller, for example.

In one or more embodiments, the power supply module may comprise one or more batteries. The battery may be rechargeable, for instance.

In one or more embodiments, the sensor is in electrical communication with the electronic module is coupled to a status indicator. The status indicator could be a light or a signal wirelessly communicated to a waiter, for example. The status indicated may be activated when the beverage level or quantity in the beverage container is below a predetermined level, for instance. The sensor may be configured to measure the weight of the beverage and container combination or be configured to read the level of beverage in the container. Those of skill in the art would appreciate that there are various ways of determining whether or not a beverage container is empty.

In other embodiments, the status indicator may be configured in the reverse from that discussed above. For instance, instead indicating when the beverage container is about empty, it could indicate when the beverage container is about full. For instance, a green light may be illuminated when the container is not empty and a red light when the container is about empty. An intermediate color may also be added, e.g. yellow, when the container is approaching empty. In such an embodiments, the color scheme may be managed with a microcontroller controlling one or more light emitting diodes with different color spectrums to provide controllability for the color of emitted light.

While the invention herein disclosed has been described by means of specific embodiments and applications thereof, numerous modifications and variations could be made thereto by those skilled in the art without departing from the scope of the invention set forth in the claims.

What is claimed is:

1. An apparatus for communicating the status of a consumable comprising:

a tubular housing with a lumen cavity, wherein the lumen cavity comprises a proximal section and a distal section separated by an internal flange;

a power module assembly comprising:

a coaster coupled on the proximal section of the tubular housing, a top cover, and a bottom cover coupled to the distal section of the tubular housing;

a sensor coupled to the coaster for determining a level of beverage in a beverage container; and electronic circuitry for controlling a status indicator, wherein the sensor is in electrical communication with the electronic circuitry; wherein the status indicator is operably coupled to the sensor.

2. The apparatus of claim 1, wherein the sensor is a spring-loaded switch on the coaster that is configured to trigger and enable the status indicator based on a predetermined weight of the beverage container.

3. The apparatus of claim 1, wherein the status indicator is light emitting diode light source on the coaster.

4. The apparatus of claim 1, wherein the electronic circuitry is housed in a chamber that is coupled to the bottom cover.

5. The apparatus of claim 1, wherein the bottom cover comprises one or more batteries.

* * * * *